US005516365A

United States Patent [19]

Sandberg et al.

[11] Patent Number: 5,516,365

[45] Date of Patent: May 14, 1996

[54] APPARATUS FOR COATING A PAPER OR CARDBOARD WEB

[75] Inventors: Cato Sandberg, Somers, Conn.; Reinhard Knop, Essen, Germany

[73] Assignee: Jagenberg Papiertechnik GmbH, Neuss, Germany

[21] Appl. No.: 310,433

[22] Filed: Sep. 22, 1994

[30] Foreign Application Priority Data

Sep. 22, 1993 [DE] Germany ..... 9314280 U

[51] Int. Cl.[6] ..... B05C 1/00

[52] U.S. Cl. ..... 118/118; 101/365; 118/203; 118/246; 118/249; 118/261; 118/262; 118/413

[58] Field of Search ..... 118/70, 126, 118, 118/203, 246, 249, 261, 262, 413; 162/281; 15/256.5, 256.51, 256.52; 101/365, 157, 169; 427/359, 361

[56] References Cited

U.S. PATENT DOCUMENTS

| | | | |
|---|---|---|---|
| 4,503,801 | 3/1985 | Collishaw et al. | 118/246 |
| 4,533,563 | 8/1985 | Dahlgren et al. | 118/261 |
| 4,672,705 | 6/1987 | Bors et al. | 118/246 |
| 4,704,296 | 11/1987 | Leanna et al. | 118/261 |
| 4,706,603 | 11/1987 | Wohlfeil | 118/410 |
| 4,901,641 | 2/1990 | Steiner et al. | 101/157 |
| 5,035,196 | 7/1991 | Mannio | 118/126 |
| 5,117,767 | 6/1992 | Sommer | 118/261 |
| 5,122,396 | 6/1992 | Rantanen | 15/256.52 |

FOREIGN PATENT DOCUMENTS

| | | | |
|---|---|---|---|
| 1922479 | 11/1970 | Germany . | |
| 2931800 | 2/1981 | Germany | 118/126 |
| 3623402 | 5/1987 | Germany . | |
| 2178677 | 2/1987 | United Kingdom . | |

OTHER PUBLICATIONS

George L. Booth, Coating Equipment and Processes, 1970, pp. 79–82.

*Primary Examiner*—Laura Collins
*Attorney, Agent, or Firm*—Herbert Dubno

[57] ABSTRACT

Paper or cardboard webs are coated by dipping an applicator roll in the liquid coating material and forming a uniform coating on that roll with a grooved doctor bar before applying the coating to the web against a drum. Thereafter, any excess is removed from the web by a doctor blade which is pressed against the web while it is on the drum.

3 Claims, 3 Drawing Sheets

APPARATUS FOR COATING A PAPER OR CARDBOARD WEB

FIELD OF THE INVENTION

Our present invention relates to an apparatus for coating a paper or cardboard web and, more particularly, to a coating apparatus of the type in which the web is looped in part around a support drum or counterroller and the coating liquid, e.g. a dyestuff or coloring substance, is applied to the web by an applicator roller.

BACKGROUND OF THE INVENTION

For the coating of paper or cardboard webs, the use of a counterroller or support drum is, of course, known. Usually the web is looped in part around the support drum and the coating material is applied in excess to the web. Downstream from the coating system, a dosing system is provided, with a doctor element which strips the excess from the web so that the desired basis weight of the coating remains on the web.

The applicator system itself can include an applicator roller which dips into a basin or tray containing the liquid coating material or coloring agent, the applicator roll forming a coating nip or gap with the control or support drum and through which the web passes. In German Patent DE-PS 36 23 402, in which such a flooded nip coating is described, there is a fixed gap between the counter-roll and the applicator roll and the coating material is supplied with the smallest possible pressure to this gap. Nevertheless efforts must be made to ensure that the gap remains completely filled for uniform coating.

The use of applicator rolls of this type to achieve with high web widths (8 m and more) and high machine speeds (800 m/min and more) uniform coatings of relatively low basis weight (weight of coating per unit area of less than say 10 g/m$^2$) has been difficult if not impossible. At high web speeds a relatively larger surplus of the coating material must be entrained by the applicator roller to the web when the applicator roller moves counter to the web, i.e. the support drum and applicator roller are driven in the same sense, so that with the resulting turbulence there will not remain any uncoated locations on the web. In the application gap the coating material tends to be pressed into the web as a result of the hydrodynamic pressure which is generated. The penetration raises the minimum basis weight which is applied to the web, since material which penetrates into the web cannot be removed in a subsequent doctoring process. The negative effects of film splitting and stress line (stripe) formation also arise in such cases. German Patent Document DE-OS 19 22 479 discloses an apparatus in which the coating is effected by opposite movements of the coating roll and the web at the coating location and hence drive of the coating roll and the support drum in the same sense. A pouring funnel applies the coating material to the coating roll and a wire wound doctor bar which is rotatably journaled is used here. This device serves effectively for the application of high basis weights of the coloring agent to the web.

OBJECTS OF THE INVENTION

It is the principal object of the present invention to provide an improved apparatus which enables the coating of webs of paper and cardboard at high web speeds and with low basis weights for high web widths with a high uniformity and hence high quality of the coating.

Another object of the invention is to provide an apparatus which is free from the drawbacks of earlier apparatus and allows small amounts of the coating material to be applied with a high degree of uniformity and reliability.

It is another object of this invention to provide an apparatus which improves the coating of webs of paper and cardboard while nevertheless ensuring that high velocities for large width webs can be maintained.

SUMMARY OF THE INVENTION

These objects and others which will become apparent hereinafter are attained, in accordance with the invention, in an apparatus of a coating of paper or cardboard web with a controller or support drum about which the web is looped, an applicator system containing an applicator roll and a device for applying the coating material to the applicator roll and a doctor bar which can be pressed adjustably against the applicator roll, can be rotated and can have peripheral grooves and is oriented between the point at which the coating material is applied to the applicator roll and the point at which it transfers this material to the web. According to the invention, the applicator roll dips into a tray or basin containing the coating material and the doctor bar is elastically pressed against the applicator roll while in the region in which the web is looped around the control or support drum, but spaced from the applicator roll, a dosing system is provided with another doctor element, especially a doctor blade, for stripping excess coating material from the web.

More particularly, the apparatus for coating the paper or cardboard web can comprise:

- a support drum around a portion of a circumference of which a web to be coated lies in contact with the drum;
- a coating device juxtaposed with the support drum and including:
  - an applicator roll rotatable into contact with a side of the web opposite a side engageable with the drum at the portion of the circumference for applying a coating material on the periphery of the roll to the web,
  - a basin containing the coating material into which the applicator roll dips and from which an emergent side of the roll entrains the coating material on the periphery, and
  - a rotatable and peripherally grooved doctor bar pressed elastically against periphery along the emergent side of the roll for stripping excess coating material from the periphery; and
  - a dosing device including a doctor element downstream of the applicator roll in a direction of displacement of the web and pressed against the web along the portion of the circumference for regulating a quantity of the coating material remaining on the web after coating thereof.

According to the invention, the doctor bar provides a precisely defined excess film on the coating roll and this excess film is transferred to the web and coating material is stripped from the latter by the doctor element or blade to leave only the desired basis weight on the web.

The transfer from the coating roll to the web is effected preferably in countermovement to the travel direction of the web so that no pressure is built up in the gap between the applicator roll and the web. The pressureless transfer has two advantages. Firstly, the penetration of the coating dye or colorant into the bibulous paper web is minimized so that with the subsequent doctor blade action, only a minimum coating remains.

Secondly, the dewatering of the coating material is minimum so that the doctoring off of the excess cannot pose a problem.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
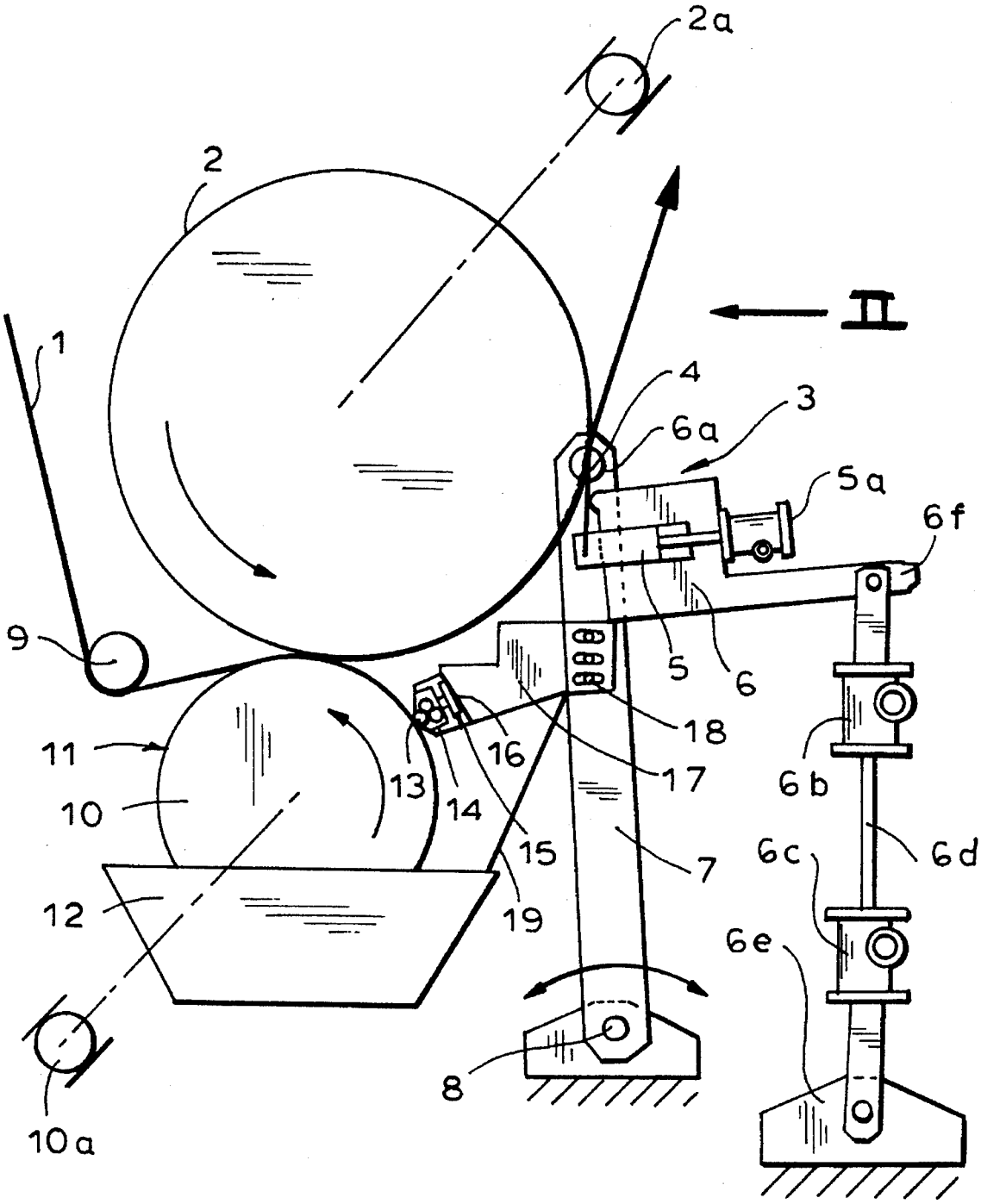
FIG. 1 is a highly schematic side view of a coating apparatus according to the invention.
Figure 2:
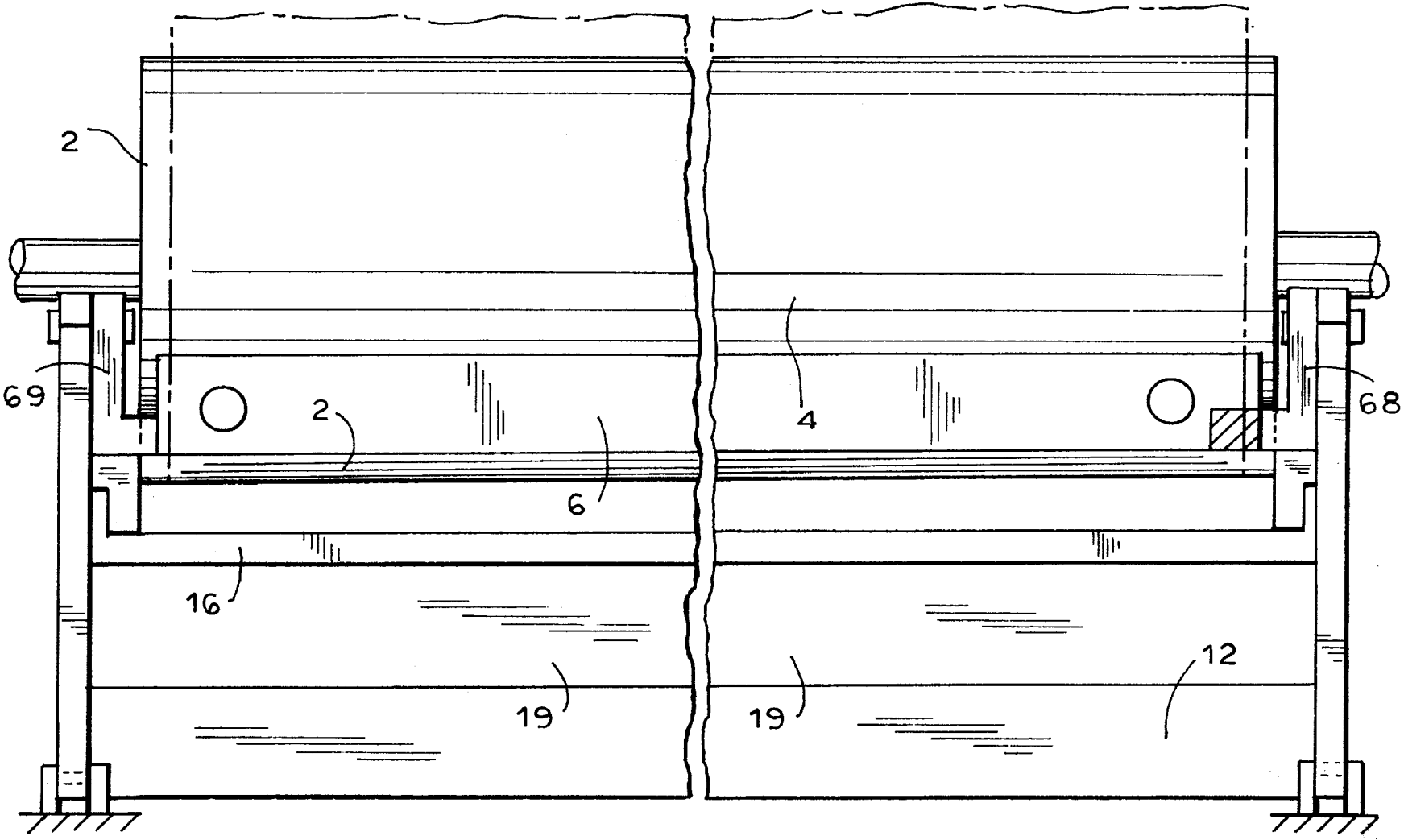
FIG. 2 a view in the direction of the arrow II of FIG. 1 partly broken away.

The coating apparatus of FIGS. 1–4 comprises a counterroll or support drum 2 around which the paper or cardboard web 1 is looped over a portion of the circumference. At a location along this looped portion of the circumference, a metering system 3 is provided which utilizes as its doctor element, a doctor blade 4. The doctor blade 4 has its base clamped in a clamping beam 5 shiftable in the direction toward the counterroll or support drum 2.

The clamping beam 5 is in turn received in a beam 6 swingable at 6*a* about an axis corresponding generally to the edge of the blade 4 via fluid operated cylinders 6*b* and 6*c* which are provided in a link 6*d* pivotally connected between a fixed location 6*e* and an arm 6*f* of the beam 6. Other cylinder arrangements 5*a* can be used to shift the blade 4 in the beam 6. The swingable movement of the beam 6 allows the pressing force of the edge of the blade 4 against the web and against the drum 2 to be adjusted along with the blade angle, i.e. an angle between the blade 4 and a tangent to the drum 2. The beam 6 has lugs 6*g* which pivotally connect the beam to a pair of pivotal levers 7 shown in their substantially vertical positions and laterally flanking the drum 2. The lever 7 can be swung about pivots 8 which are also fixed to bring the metering system from its working position shown in FIG. 1, into a lower maintenance and weighting position as may be desired.

Before the web reaches the drum 2 it is guided by the roller 9, for example, onto the applicator roll 10 of an applicator system 11 so that the web is partially slung around the applicator roll 10. The applicator roll 10 is driven by a drive represented at 10*a* in the same sense as the drive 2*a* drives the drum 2. The applicator roll 10 thus moves in a direction opposite the direction of displacement of the web.

Figure 4:
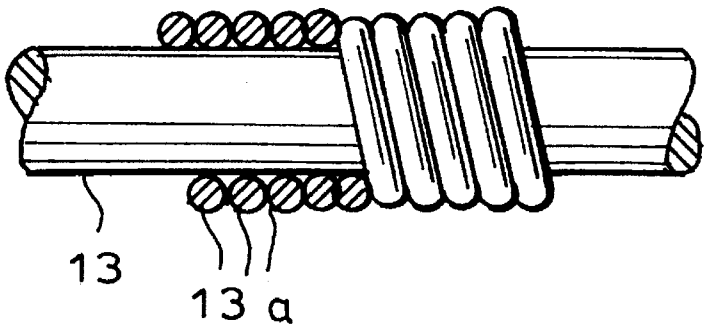
FIG. 4 is an elevational view of the doctor bar.
Figure 3:
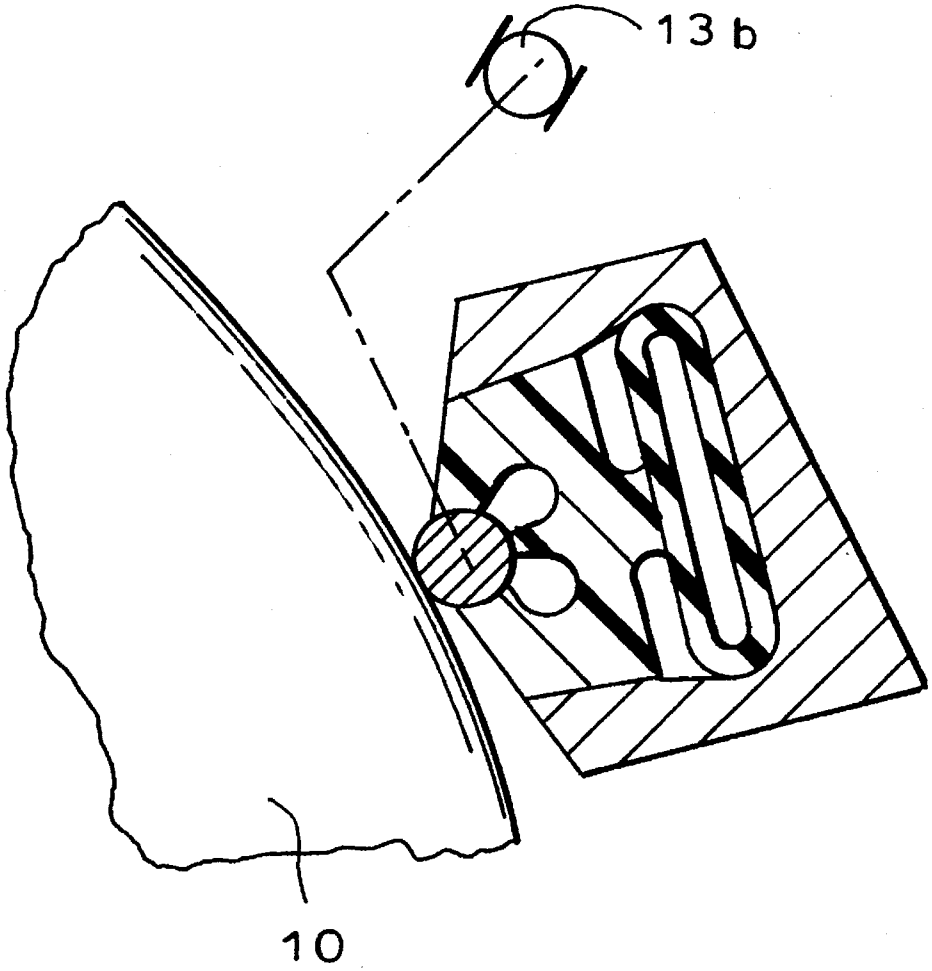
FIG. 3 is a detail cross section showing the mount of the doctor bar.

At its lower portion the applicator roll 10 dips into a basin or tray 12 which contains the liquid coating material to be applied to the web. At its right or emergent side, the applicator roll 10 is engaged by a doctor bar 13 which serves to strip excess coating material from the coating roll 10 to leave only a uniform thin film of the coating material which reaches the web. The doctor bar 13 is a roller as shown in FIG. 4 which can be wound with a wire 13*a* or otherwise provided with a peripheral array of grooves and which is rotated by a drive represented at 13*b* in FIG. 3.

The doctor bar 13 is rotatable in an elastic bed 14 and can be pressed by inflation of an air bladder 15 with an adjustable pressing force against the surface of the applicator roll. The bed 14, the air bladder 15 and the doctor bar 13 all extend the full machine width in a holder 16 which also extends the full machine width and is secured at opposite ends to plates or brackets 17. The plates 17 are connected by slots and locking screws to the lateral levers 7 of the dosing system 3 so that the doctor bar 13 can be swung toward the applicator roll 10 when the dosing system 3 is brought into operation. The slots 18 allow adjustment of a predetermined spacing of the doctor bar 13 with respect to the applicator roll 10. Directly below the attachment edge the plates 17 and the pivot arms 7 can be connected to a machine-wide apron 19 of polyvinylchloride as a spray shield, the apron 19 reaching into the basin 12.

As has been noted, the doctor bar 13 has peripheral grooves which can be formed by winding the bar with a wire or can be machined in the bar. When a wire wound bar is used, the diameter of the wire can be 0.6 mm to 2 mm. When a machined surface is used, the grooves should have flow cross sections corresponding to those provided by the wire In operation, the supply of compressed air to the bladder 15 can press the doctor bar 13 with a predetermined pressing force against the applicator roll 10. The applicator roll 10 dips into the coating material and entrains the coating material in excess from the basin and the coating material is stripped to leave on the coating drum 1.1 to 3 times and preferably 1.5 to 2 times the desired basis weight following the removal of excess by the blade 4. Simultaneously, the doctor bar 13 provides a very uniform film on the surface of the applicator roll 12 and which is then transferred to the web 1. Because of the ccountermovements of the applicator roll 10 and the web 1 during the transfer, practically no hydrodynamic pressure is built up and penetration of the coating material into the web is minimized. In addition, the coating material is rubbed against the web on transfer so that a highly uniform coating is produced. This coating on the web can be doctored by the blade 4 to a minimum basis weight. Negative effects like film striping and striping can be reduced or eliminated.

In some cases it may be desirable to drive the applicator roll 10 in direction opposite the support roll 2 but in the same direction as the web 1. This displacement in the same direction of the web does give good results on transfer in the case where the coating liquid has rheological properties or the operating conditions are such that effective coatings cannot otherwise be obtained.

We claim:

1. An apparatus for coating a paper or cardboard web, comprising:

a support drum having a circumference around a portion of which a web to be coated lies in contact with said drum;

a coating device disposed adjacent said support drum and including:

an applicator roll having a periphery rotatable into contact with a side of said web opposite a side engageable with said drum at said portion of said circumference for applying a coating material on said periphery of said roll to said web, a basin containing said coating material into which said applicator roll dips and from which an emergent side of said roll entrains said coating material on said periphery, and a rotatable and peripherally grooved doctor bar pressed elastically against periphery along said emergent side of said roll for stripping excess coating material from said periphery; and a dosing device including a doctor element downstream of said applicator roll in a direction of displacement of said web and pressed against said web along said portion of said circumference for regulating a quantity of said coating material remaining on said web after coating thereof, said doctor element being a blade having an edge pressed against said web, said dosing device comprises:

a swingable arm, and a blade carrier mounted on said swingable arm, said blade being provided on said carrier and being swung toward said web on said arm, said doctor bar being mounted on the arm.

2. The apparatus defined in claim 1 wherein said applicator roll and said support drum are provided with drive means for rotating said applicator roll and the support drum in the same rotational direction.

3. The apparatus defined in claim 1, further comprising guide means for said web causing said web to loop at least in part over said applicator roll.

* * * * *